US005823257A

United States Patent [19]

Peyton

[11] Patent Number: 5,823,257

[45] Date of Patent: Oct. 20, 1998

[54] ROTATABLE WET CONNECT FOR DOWNHOLE LOGGING DEVICES

[76] Inventor: Mark Alan Peyton, No. 3 Oilpatch La., Gonzales, Tex. 78692

[21] Appl. No.: 720,953

[22] Filed: Oct. 4, 1996

[51] Int. Cl.[6] ..... E21B 23/00

[52] U.S. Cl. ..... 166/65.1; 439/190

[58] Field of Search ..... 266/254.2, 65.1, 266/66; 439/13, 190, 194

[56] References Cited

U.S. PATENT DOCUMENTS

| | | | |
|---|---|---|---|
| 4,174,875 | 11/1979 | Wilson et al. | 439/190 X |
| 4,921,438 | 5/1990 | Godfrey et al. | 166/65.1 X |
| 5,058,683 | 10/1991 | Godfrey et al. | 166/65.1 X |
| 5,141,051 | 8/1992 | Lenhart | 166/65.1 |
| 5,358,418 | 10/1994 | Carmichael | 439/190 |
| 5,389,003 | 2/1995 | Van Steenwyk et al. | 439/194 X |

*Primary Examiner*—William P. Neuder
*Attorney, Agent, or Firm*—Jesse D. Lambert

[57] ABSTRACT

A rotatable wet connect for downhole logging devices. A male shaft is disposed downhole within a drill string. A contact rod of an electrically conducting material having a prong at its uphole end extends through the male shaft, the contact rod electrically insulated from the male shaft. The contact rod electrically connects to a downhole logging device. A shoulder is disposed about a lower portion of the male shaft. A circumferential groove containing a multitude of ball bearings extends about the male shaft adjacent the uphole side of the shoulder. A collar is disposed over the male shaft and rests atop and retains the ball bearings. Set screws retain the collar in place on the male shaft. Once in place atop the ball bearings, the collar may rotate freely about the male shaft. A female sleeve carries a spring biased disc for making electrical contact with the prong of the male shaft. The disc is electrically coupled to the spring, which in turn is electrically coupled to the wireline.

The female sleeve is lowered via an electric wireline over the male shaft, the bore of the female sleeve closely engaging the male shaft. The disc, spring biased downward to a first position, contacts the prong and establishes electric connection with the surface. The female sleeve continues downhole to rest atop the collar, the rotating collar supporting the female sleeve, enabling relative rotation between the female sleeve and the male shaft.

13 Claims, 3 Drawing Sheets

FIG. 1
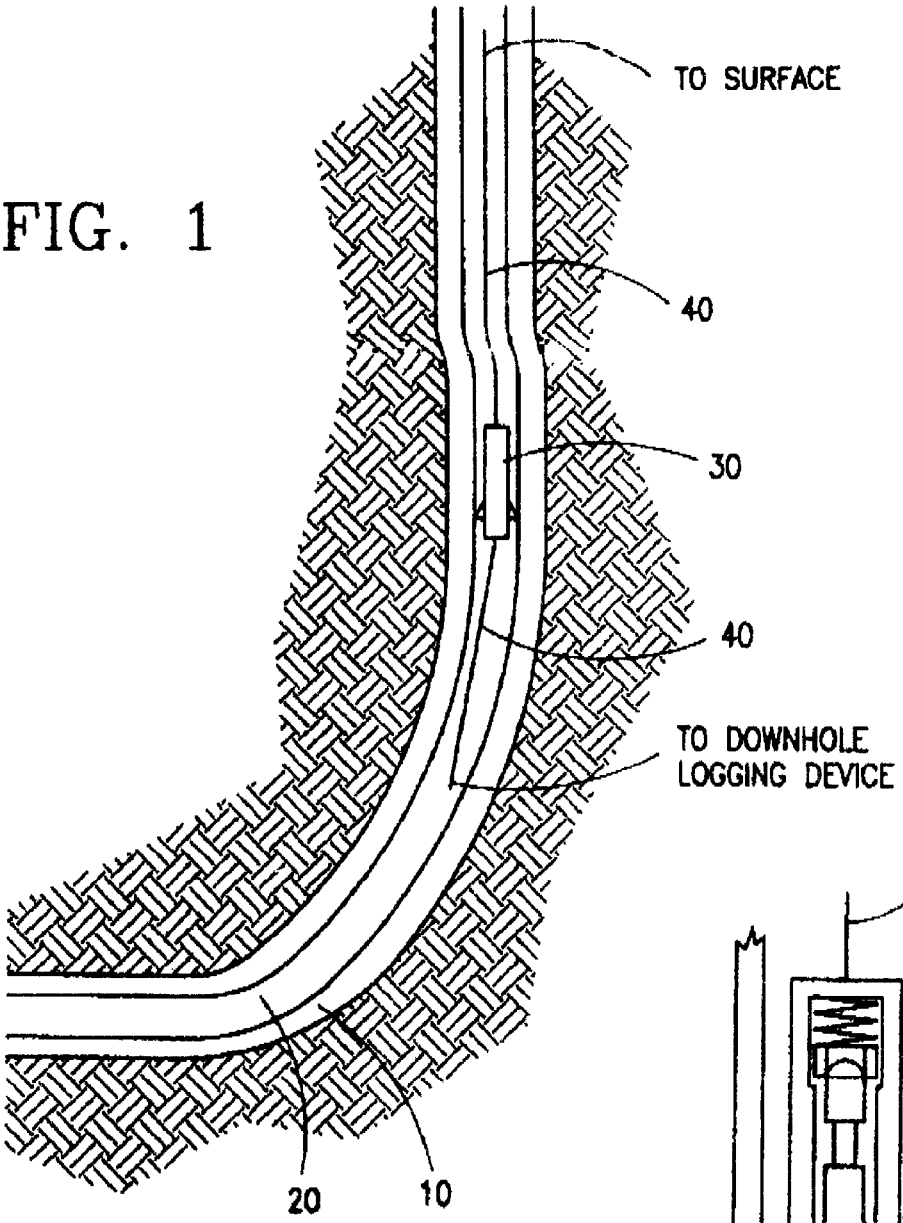
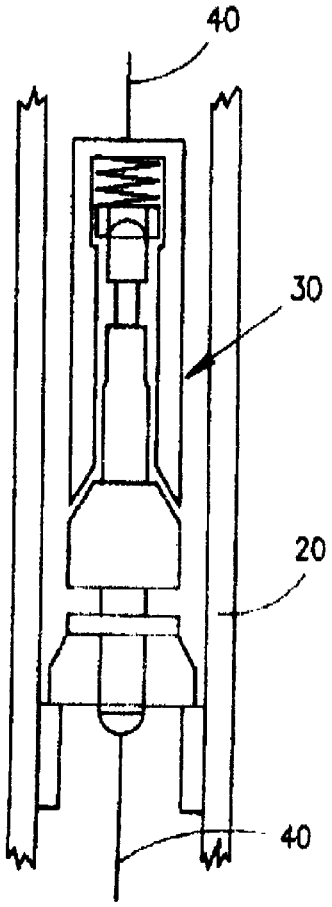
FIG. 2

ROTATABLE WET CONNECT FOR DOWNHOLE LOGGING DEVICES

A. BACKGROUND OF THE INVENTION (1) Field of the Invention

This invention relates to downhole tools employed in drilling oil and gas wells, and with more particularity to electrical connector devices by which an electrical connection can be made with a downhole logging device via an electric wireline extending from the surface to the connector. With still further specificity, this invention relates to a downhole electrical connector in a wireline which permits rotation between the wireline and the downhole logging device while maintaining the electric connection and permitting electrical signal transmission through the wireline, while permitting coupling and decoupling of the connector.

(2) Description of the Related Art

In the field of drilling oil and gas wells, many devices have been developed to determine various conditions existing downhole in the wellbore, including such parameters as downhole pressure and temperature. Of usually greater importance is information relating to such things as the downhole lithology, or the nature of the rock formation being drilled through, to determine whether such formations are, for example, shales or sands. "Sands" are the more permeable formations that typically contain oil and gas in commercial quantities under viable flowing conditions, and for that reason the identification of sand intervals is important.

Further, the type of fluid present in the rock formation is of key importance, and various downhole logging devices exist to distinguish between salt water bearing formations and oil and gas bearing formations.

Another type of downhole borehole information that is of high importance is that related to the angle (deviation from vertical) and azimuth (direction along a compass reading) of the borehole. In the early days of drilling oil and gas boreholes, a "vertical" borehole was nearly always desired, even though in practical terms virtually every borehole possesses some degree of deviation at various points along its trajectory. More recently, however, the practice of drilling intentionally deviated wellbores, or "directional" drilling, developed to meet a variety of situations in which vertical (or nearly vertical) boreholes were not satisfactory. For example, in offshore drilling operations, particularly in the development of oil and gas fields, all drilling may be done from a fixed platform usually centrally located over the oil and gas reservoirs. In order to penetrate desired formation targets, the bottom hole locations of the wells may need to be deviated thousands of feet from their surface location. It is of utmost importance to know with great precision the angle and direction of the borehole along the way so as to penetrate the desired targets.

Increasingly, environmental concerns warrant the drilling of deviated boreholes. A desired downhole location may have a surface location that is located in an environmentally sensitive area, where the placement of a drilling location and potentially a production facility would be very expensive or outright prohibited. In such situations, an operator may drill a directional well with a surface location in a less sensitive area, achieving a greatly reduced overall well cost despite the higher cost to drill a directional well.

In response to the great demand for directional wells, many types of downhole survey devices have been developed. Traditionally, the directional information from such devices was retrieved by retrieving the entire tool, or by connecting to the downhole tool with a downhole "wet connect" that permitted transmission of downhole directional data while rotary drilling was halted, although drilling with a downhole motor might still continue. Rotary drilling traditionally had to be halted to prevent twisting of the electric wireline, as conventional equipment provided no means by which the drillstring and the downhole tool could rotate independently of the electric wireline.

In order to avoid the operational limitations presented by electric wireline and permit greater flexibility in data transmission, measurement while drilling or "MWD" tools developed. Many of such tools work off of mud pulse technology to transmit the directional information to the surface. These MWD tools employ a downhole survey tool that encodes directional information into electrical signals which then function a mud pulser which creates positive mud pressure pulses that can be detected and interpreted at the surface.

However, such mud pulse MWD tools possess several inherent drawbacks. One is the high cost of using such tools. Rental charges for MWD tools can represent a significant portion of the overall drilling costs of a well. In addition, should an MWD tool be lost in the hole due to stuck pipe, a drill string failure, or other reasons, the purchase price to reimburse the MWD tool company is quite high. In addition to costs, data transmission efficiency by mud pulse technology is inferior to that by electric wireline. Transmission of the electrical signals from a downhole survey instrument representing borehole directional information is done much more efficiently by a wireline and much greater volumes of data can be so transmitted. However, prior art downhole electrical connectors generally are not designed to permit rotation of the drill string while the electrical connection is engaged; that is, since the downhole tool to which the electric wireline ultimately connects rotates with the drillstring, the wireline would necessarily turn with the downhole tool, and since the wireline at the surface is prevented from rotation, the wireline would twist while rotary drilling took place. Ideally, an operator would be able to achieve the high data transmission efficiency permitted by wireline, while retaining the ability to rotary drill while data is being transmitted (that is, while the downhole connection is engaged) as allowed by mud pulse MWD tools.

Brown et al, U.S. Pat. No. 5,468,153 (Nov. 21, 1995) is an example of a prior effort to enable wireline connection to a downhole tool while permitting drillstring rotation while drilling. To do so, Brown discloses a two part tool, the first part being a conventional (substantially non-rotatable) downhole "wet connect" coupled with a rotatable swivel (in the nature of an electrical slip ring) disposed in the wireline between the surface and the wet connect. Therefore, the connect/disconnect function is provided by the conventional wet connect, while the rotation function is provided by the separate, additional electrical swivel. Although such apparatus permits drill string rotation while transmitting electrical data, in order to do so it introduces an additional mechanical device (the separate downhole swivel) into the wireline string, in turn introducing additional possibilities of mechanical failure and complexity.

It is desired to have a single downhole tool that performs the dual function of (i) allowing downhole electrical connecting and disconnecting of an electric wireline from a downhole tool and (ii) permitting the drillstring and the downhole tool to rotate independently from the electric wireline, while eliminating the need for a separate, additional swivel as set forth in the prior art. It is therefore an object of the present invention to provide an improved apparatus for permitting rotary drilling of an earth borehole while maintaining electrical connection by an electric wireline between the surface and a downhole logging instrument. It is another object of the present invention to provide an apparatus disposed downhole in an electric wireline that permits connecting to and disconnecting from a downhole tool and that permits relative rotation between the electric wireline and the drillstring. Additional objects of the present invention include providing a rotatable downhole wireline connect for logging devices that employs a minimum of electrical connectors and provides increased mechanical durability and reliability.

B. SUMMARY OF THE INVENTION

The rotatable wet connect for downhole logging devices is characterized by a male shaft disposed downhole within a drill string, the male shaft having a longitudinal bore therethrough. A contact rod of a suitable electrically conducting material is disposed within the bore, with an insulator electrically insulating the contact rod from the male shaft. The uphole end of the contact rod forms a prong, also of a suitable electrically conducting material. The downhole end of the contact rod electrically connects to a downhole logging device, which may provide either or both of wellbore directional or formation evaluation information.

The male shaft comprises a shoulder disposed about the lower portion of the male shaft. A circumferential groove extends about the male shaft immediately above the shoulder, providing a race or bearing groove for a multitude of ball bearings to be contained within. A collar having a sloping shoulder on its uphole end is disposed over the male shaft and rests atop the ball bearings, with a skirt of the collar extending downward retaining the bearings in place and covering the shoulder on the male shaft. Set screws inserted into the male shaft immediately above the collar retain the collar in place. Once in place atop the ball bearings, the collar is able to rotate freely about the male shaft. The assembly comprising the male shaft, contact rod, collar, and bearings is held at an appropriate location within a drillstring with an appropriate seating means.

The present invention further comprises a female sleeve having a longitudinal bore therethrough. A disc of a suitable electrically conductive material is carried in the bore proximal the uphole end of the sleeve, with the disc longitudinally movable within the bore. The disc is spring biased so as to be forced in a downhole direction. The disc is electrically coupled to the spring, which in turn is electrically coupled to the wireline extending to the surface.

In use, the female sleeve is lowered via an electric wireline and slides over the prong, contact rod, and male shaft, the bore diameter of the female sleeve permitting a close engagement with the male shaft. The disc, spring biased downward to a first position, contacts the prong and establishes electric connection with the surface. The resulting electric path, in sequence from the surface, is wireline—spring—disc—prong—contact rod—wireline—downhole tool. The female sleeve continues downward until a bottom sloping profile in the bore of the female sleeve rests atop the rotatable collar. The collar then supports the weight of the female sleeve. Relative rotation between the female sleeve and the male shaft is then possible with the collar rotating freely on the bearings and the prong rotating relative to the disc. Grease or other suitable lubricant may be provided in the bearing area to ease rotation of the collar/female sleeve with respect to the male shaft.

C. BRIEF DESCRIPTION OF THE DRAWINGS

FIG. 1 is a cross section of a wellbore with a drillstring therein, with a simplified schematic of the present invention showing its placement in the wellbore.

FIG. 2 is a schematic in partial cross section, showing a simplified drawing of the apparatus of the present invention in its seated position within a drillstring.

D. DESCRIPTION OF THE PREFERRED EMBODIMENT

Figure 3:
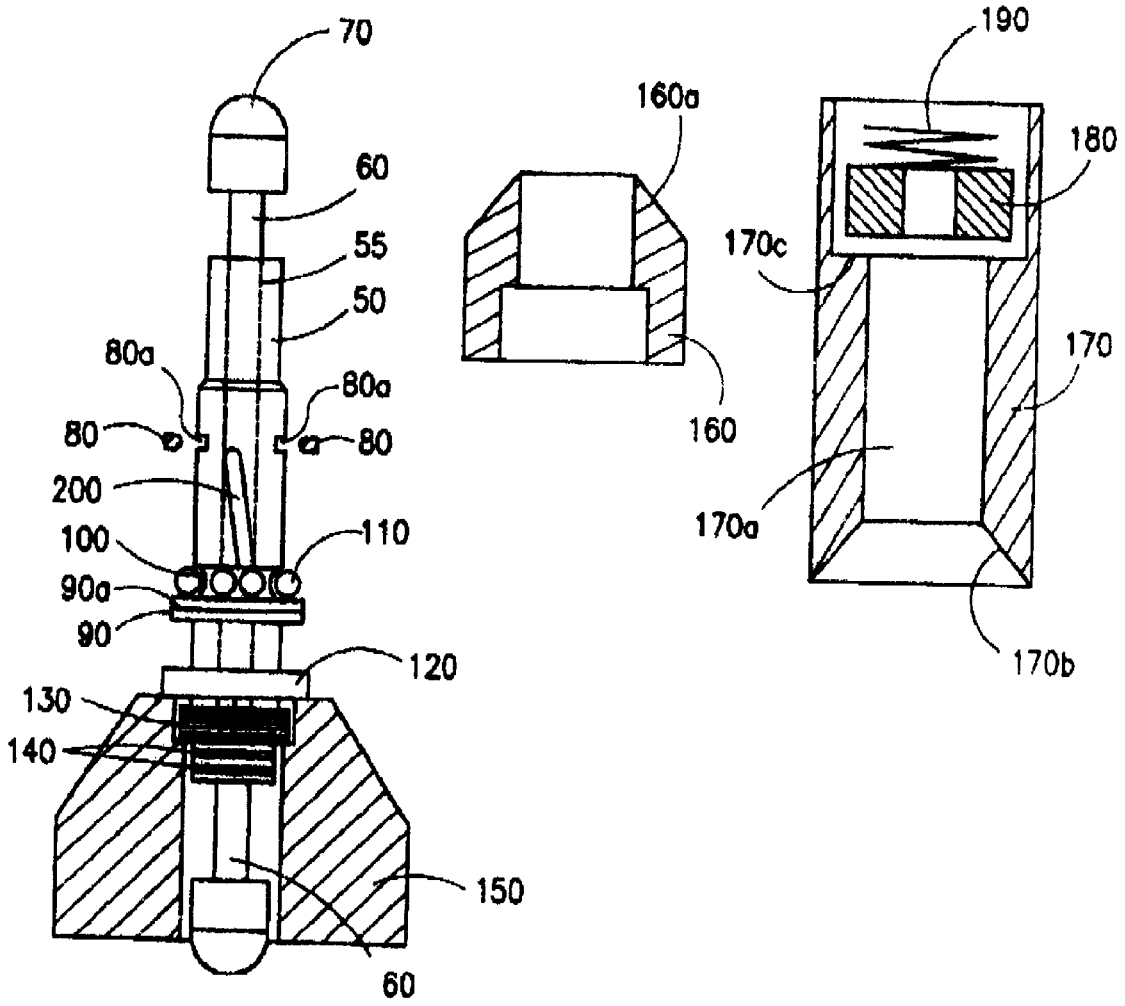
FIG. 3 is a detailed schematic in cross section of the rotatable wet connect of the present invention, showing the male shaft assembly, collar and bearing assembly, and female shaft, all in disassembled view.

With reference to FIGS. 1 through 4, one embodiment of the rotatable wet connect for downhole logging devices of the present invention will be described.

FIG. 1 shows in simplified cross section a wellbore 10 within which is disposed a drillstring 20. Wellbore 10 is shown as a "directional" well (that is, non-vertical), although use of the present apparatus is not limited to directional wellbores. The rotatable wet connect apparatus 30 is shown seated within drillstring 20 with wireline 40 extending from the apparatus to the surface and from the apparatus to the downhole tool.

FIG. 2 shows in increasing detail the rotatable wet connect apparatus 30 seated within drillstring 20, with wireline 40 extending from said apparatus to the surface and to the downhole tool.

In FIG. 3, the apparatus of the present invention is shown in cross-section detail. Male shaft 50 has a longitudinal bore therethrough. Contact rod 60 extends through the bore in male shaft 50, with insulator 55 disposed between contact rod 60 and the bore in male shaft 50, thereby electrically insulating contact rod 60 from male shaft 50. Prong 70 is fastened to the uphole end of contact rod 60 and is electrically coupled thereto. Prong 70 and contact rod 60 are of a suitable electrically conductive material, typically stainless steel, although other materials could be used. In the preferred embodiment, prong 70 has a rounded uphole end, although it is understood that other profiles could be used as well. At its downhole end, contact rod 60 electrically connects to a downhole logging tool, not shown, either directly or via an intervening length of wireline.

Bearing means are disposed between male shaft 50 and collar 160, as will be described herein. Male shaft 50 has a first shoulder 90 disposed circumferentially around it. Adjacent an uphole side of first shoulder 90 is a circumferential groove 100 which provides a receptacle or race for ball bearings 110. When in place, ball bearings 110 travel upon first shoulder 90 and are contained partially within groove 100. Lubricating groove 200 provides a means for supplying lubricating material, such as grease, from bore 170*a* of female sleeve 170 to ball bearings 110. Lubricating groove 200 is at an angle to the longitude of male shaft 50 in order to guide lubricant from bore 170*a* of female sleeve 170 to ball bearings 110, as will be described below. In the preferred embodiment, a plurality of ball bearings is provided to ensure a low friction, easily rotatable bearing means assembly. It is understood, however, that other bearing arrangements, such as needle bearings or flat contact bearings. Retaining means, in the preferred embodiment comprising set screws 80 engaged in corresponding threaded holes 80*a* in male shaft 50, retain collar 160 in place, as will be described more fully below.

Means for seating male shaft 50 within drillstring 20 comprise a second shoulder 120 on male shaft 50 abutting finned support member 150 when male shaft 50 is assembled into finned support member 150. Finned support member 150 in turn rests in an appropriate receiving profile within drillstring 20, as shown in FIG. 2, to hold the apparatus at a desired depth. Male shaft 50 is fastened within finned support member 150 by threaded section 130 engaging a cooperative threaded section within the bore of finned support member 150. Seals 140 may be disposed about male shaft 50 within the bore of finned support member 150 to prevent passage of fluids, such as wellbore fluids, between finned support member 150 and male shaft 50. Seals 140 may be resilient seals of an O-ring configuration or of other suitable configurations. While the profile of the preferred embodiment of finned support member 150 is shown herein, it is understood that various other shapes could be used.

Collar 160 has an inner profile to accommodate male shaft 50, shoulder 90, and ball bearings 110, as described more fully below.

Female sleeve 170 has a bore 170*a* therethrough for receiving male shaft 50. Electric contact means comprise disc 180 carried within an uphole section of bore 170*a*, and disc 180 may travel longitudinally within bore 170. Shoulder 170*c* limits downhole movement of disc 180. Spring 190 biases disc 190 toward a downhole position while permitting travel of disc 180 in an uphole direction. Shoulder 170*b* mates with and seats on shoulder 160*a* of collar 160, as will be described more fully below. Disc 180 and spring 190 are of a suitable electrically conductive material.

Figure 4:
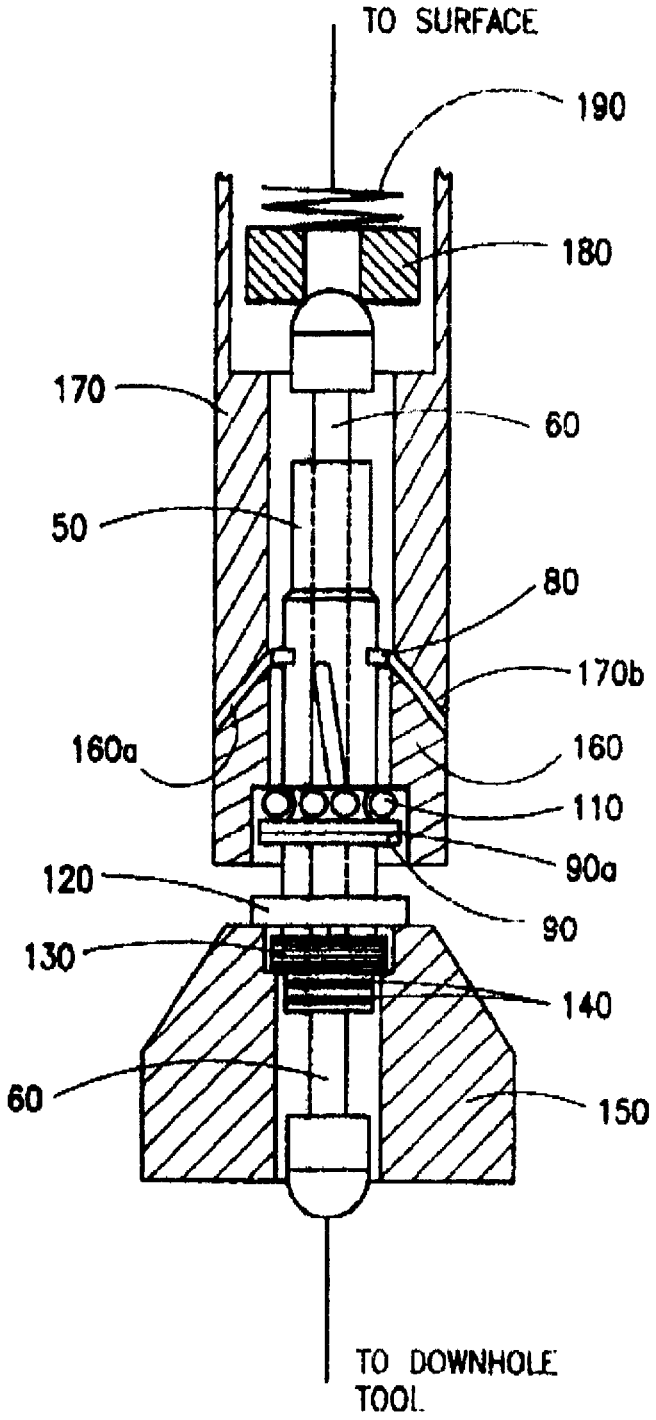
FIG. 4 is a detailed schematic in partial cross section of the rotatable wet connect, showing the apparatus in assembled form with the female sleeve in place over the male shaft.

With reference to FIG. 4, the fully assembled apparatus of the present invention will be described. Male shaft 50 is held within finned support member 150. Collar 160 is disposed over male shaft 150 to a position atop ball bearings 110. Set screws 80 are made up in threaded holes 80*a*, with a portion of set screws 80 protruding sufficiently from male shaft 50 to prevent movement of collar 160 from its position atop ball bearings 110, although sufficient clearance is provided to permit easy rotation of collar 160. Collar 160 extends downhole past first shoulder 90, with the inner profile of collar 160 engaging seal 90*a* and preventing passage of fluid between collar 160 and shoulder 90. The assembly, held within finned support member 150, is in turn seated within drillstring 20, as shown in FIG. 2.

To engage the downhole rotatable connector, female sleeve 170 is lowered from an uphole position on electric wireline 40. As female sleeve 170 approaches prong 70, the slope of shoulder 170*b* helps to center female sleeve 170 and guide female sleeve 170 over male shaft 50. Bore 170*a* and male shaft 50 are cooperatively dimensioned so as to provide a close engagement therebetween. As female sleeve 170 is lowered over male shaft 50, disc 180 engages prong 70. At said engagement, an electrical path is created from the uphole wireline section, through spring 190, disc 180, prong 70, and contact rod 60, from that point to a downhole logging tool. Spring 190 biases disc 180 toward prong 70 so as to ensure close engagement and electric conduction therebetween.

As female sleeve 170 continues downhole, shoulder 170*b* on female sleeve 170 engages shoulder 160*a* on collar 160. The weight of female sleeve 160 is thereby transferred to collar 160 and then to ball bearings 110. In the preferred embodiment, disc 180 engages prong 70 approximately two inches of longitudinal travel before shoulders 170*b* and 160*a* engage, although other suitable spatial relationships could be used.

Lubricating groove 200 extends from circumferential groove 100 along male shaft 50 to a point outside of collar 160, when collar 160 is in place on male shaft 50, as shown in FIGS. 3 and 4. Typically, the interior of female sleeve 170 is filled with grease before lowering into the drillstring to engage male shaft 50. Lubricating groove 200 is at an angle to a longitudinal axis of male shaft 50, so that relative rotation between female sleeve 170 and male shaft 50 guides lubricant from female sleeve 170 into the bearing assembly area. Alternatively, seal 90*a* may be provided on first shoulder 90, providing a fluid seal between first shoulder 90 and collar 160. A lubricant, such as grease, may be placed in the bearing assembly before collar 160 is put in place on male shaft 50.

With female sleeve 170 engaged on male shaft 50, an electric flowpath is created from the logging device to contact rod 60, through contact rod 60 to prong 70, from prong 70 to disc 180, from disc 180 to spring 190, and from spring 190 to wireline 40 leading to the surface. Disc 180 may rotate upon prong 70 while maintaining full electric conductivity.

During rotary drilling, the downhole logging tool will rotate along with drillstring 20. In like manner, finned support member 150 and male shaft 50 will rotate along with drillstring 20. Collar 160 and female sleeve 170 will remain substantially stationary, as will wireline 40 extending from the apparatus to the surface. Drillstring 20 will rotate around the exterior of female sleeve 170 and collar 160, while male shaft 50 is rotating within female sleeve 170. The apparatus thereby permits rotary drilling while maintaining electrical connection with the downhole logging device.

Electrical connection with the downhole logging device may be made and broken as desired by picking up female sleeve 170 via wireline 40 a sufficient distance to disengage disc 180 from prong 70. Female sleeve 170 and wireline 40 may be fully retrieved from drillstring 20 should same be desired. When connection with the downhole tool is once again desired, female sleeve 170 can then be again lowered over male shaft 50 and electrical contact made.

The preferred embodiment disclosed herein provides and apparatus for making positive electrical contact with a downhole logging tool, while permitting connecting and disconnecting from said tool as desired, and while permitting easy, low friction relative rotation between the wireline and the downhole tool. The bearing assembly, which in the preferred embodiment comprises ball bearings, provides vertical support for the female sleeve and turns easily about the male shaft.

Although a preferred embodiment is set forth in the description above and the appended drawings, it will be understood to those skilled in the art that various modifications could be made without departing from the spirit of the invention. Accordingly, the scope of the present invention should be interpreted solely from the following claims, as such claims are read in light of the disclosure.

I claim:

1. An apparatus for electrically connecting an electric wireline to a downhole logging tool used in an earth borehole, said apparatus permitting relative rotation between said downhole logging tool and said electric wireline, comprising:

a male shaft;

a contact rod extending through said male shaft, said contact rod adapted to electrically couple to a downhole logging tool;

a female sleeve adapted to couple to an electric wireline, said electric wireline extending towards the surface of an earth borehole, said female sleeve having a longitudinal bore for receiving said male shaft therein;

electrical contact means disposed within said female sleeve and adapted to electrically couple to said electric wireline, for contacting said contact rod and providing an electric flowpath from said contact rod to said electric wireline when said male shaft is engaged within said bore of said female sleeve; and bearing means comprising a plurality of ball bearings disposed on said male shaft, said bearing means axially supporting said female sleeve when said male shaft is received within said bore of said female sleeve, said bearing means and said female sleeve thereby rotatable about a longitudinal axis of said male shaft.

2. An apparatus for electrically connecting an electric wireline to a downhole logging tool used in an earth borehole, said apparatus permitting relative rotation between said downhole logging tool and said electric wireline, comprising:

a male shaft;

a contact rod extending through said male shaft, said contact rod adapted to electrically couple to a downhole logging tool;

a female sleeve adapted to couple to an electric wireline, said electric wireline extending towards the surface of an earth borehole, said female sleeve having a longitudinal bore for receiving said male shaft therein;

electrical contact means disposed within said female sleeve and adapted to electrically couple to said electric wireline, for contacting said contact rod and providing an electric flowpath from said contact rod to said electric wireline when said male shaft is engaged within said bore of said female sleeve; and bearing means disposed on said male shaft, said bearing means comprising a first shoulder disposed about said male shaft, a circumferential groove adjacent an uphole side of said shoulder, said first shoulder and said circumferential groove defining a bearing race, a plurality of ball bearings disposed within said bearing race, and a collar disposed around said male shaft, said collar atop said ball bearings and confining said ball bearings within said race, said collar rotatable about a longitudinal axis of said male shaft, said bearing means supporting said female sleeve when said male shaft is received within said bore of said female sleeve, said bearing means and said female sleeve thereby rotatable about a longitudinal axis of said male shaft.

3. The apparatus of claim 2, further comprising a lubricating groove in said male shaft, said lubricating groove extending from said circumferential groove to a terminus at a position outside an uphole end of said collar, said lubricating groove having a direction at an angle to a longitude of said male shaft.

4. The apparatus of claim 2, further comprising seal means disposed circumferentially on said first shoulder between said collar and said first shoulder.

5. The apparatus of claim 4, wherein said seal means comprise resilient seal means.

6. A rotatable wet connect for connecting an electric wireline to a downhole logging tool used in earth boreholes, comprising:

a male shaft having a longitudinal bore therethrough;

a contact rod having uphole and downhole ends extending through said bore in said male shaft, said contact rod capable of conducting an electric signal, said uphole end of said contact rod having a prong thereon, said downhole end of said contact rod adapted to electrically couple to a downhole logging tool;

electric insulating means disposed between said contact rod and said male shaft;

a collar disposed about said male shaft and rotatable around a longitudinal axis of said male shaft, said collar having an uphole shoulder;

bearing means disposed between said collar and said male shaft;

a female sleeve adapted to couple to an electric wireline, said female sleeve having a longitudinal bore for receiving said male shaft therein, said female sleeve having a downhole shoulder for mating with said uphole shoulder of said collar, said collar supporting said female sleeve thereby; and electric contact means carried within said female sleeve, said contact means adapted to electrically couple to said electric wireline, said electric contact means for contacting said prong of said contact rod when said male shaft is received within said bore of said female sleeve, forming an electric flowpath from said electric wireline to said contact rod.

7. The apparatus of claim 6, wherein said bearing means comprises a first shoulder disposed about said male shaft and a circumferential groove adjacent an uphole side of said shoulder, said first shoulder and said circumferential groove defining a bearing race;

a plurality of ball bearings disposed within said bearing race; and wherein said collar is atop said ball bearings, a portion of said collar extending toward said first shoulder and confining said ball bearings within said race.

8. The apparatus of claim 7, further comprising retaining means for preventing movement of said collar longitudinally along said male shaft.

9. The apparatus of claim 8, further comprising a lubricating groove in said male shaft, said lubricating groove extending from said circumferential groove to a terminus at a position outside an uphole end of said collar, said lubricating groove having a direction at an angle to a longitude of said male shaft.

10. The apparatus of claim 9, wherein a portion of said collar extends to a position opposite said first shoulder, and further comprising seal means disposed circumferentially on said first shoulder between said collar and said first shoulder.

11. The apparatus of claim 10, wherein said seal means comprise resilient seal means.

12. The apparatus of claim 11, further comprising means for seating said male shaft within a drillstring in a desired downhole location.

13. The apparatus of claim 12, wherein said electric contact means comprises a disc having a bore therethrough, said disc carried within said bore of said female sleeve and longitudinally movable therein, said contact means further comprising a spring biasing said disc toward a downhole end of said female sleeve.

* * * * *